US006460982B1

(12) United States Patent
Ito et al.

(10) Patent No.: US 6,460,982 B1
(45) Date of Patent: Oct. 8, 2002

(54) INK SUPPLEMENT SYSTEM

(75) Inventors: Takuro Ito, Shizuoka-ken; Shinichiro Fujii, Mishima, both of (JP)

(73) Assignee: le;.5qToshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/491,821

(22) Filed: Jan. 26, 2000

(30) Foreign Application Priority Data

Jan. 27, 1999 (JP) ..... 11-018424

(51) Int. Cl.[7] ..... B41J 2/175; B67C 3/00
(52) U.S. Cl. ..... 347/85; 141/351
(58) Field of Search ..... 347/85–87, 93; 141/351, 346; 222/153.09, 153.13, 153.14, 325, 482, 82

(56) References Cited

U.S. PATENT DOCUMENTS 5,900,896 A * 5/1999 Barinaga et al. ..... 347/86
6,032,010 A * 2/2000 Kim et al. ..... 347/86

FOREIGN PATENT DOCUMENTS

| | | | |
|---|---|---|---|
| JP | 59-33153 | 2/1984 | |
| JP | 63-153146 A * | 6/1988 | ..... 347/93 |
| JP | 10-138520 | 5/1998 | |

* cited by examiner

*Primary Examiner*—Judy Nguyen
(74) *Attorney, Agent, or Firm*—Frishauf, Holtz, Goodman & Chick, P.C.

(57) ABSTRACT

An ink supplement system comprises a bottle holder unit for holding an ink bottle storing ink and detachably attached thereto, and an ink tank for receiving ink from the ink bottle held by the bottle holder unit. Particularly, the ink bottle includes an ink supply port having a filter affixed to a back thereof, and the bottle holder unit includes an ink supplement pump which suctions ink through the ink supply port of the ink bottle attached to the bottle holder unit so as to supplement the ink into the ink tank.

24 Claims, 6 Drawing Sheets

INK SUPPLEMENT SYSTEM

BACKGROUND OF THE INVENTION

The present invention relates to an ink-jet printer for printing an image on a print medium with ink ejected from a print head, and more specifically to an ink supplement system for supplementing ink from a detachable ink bottle to an ink tank which stores ink to be supplied to the print head.

For example, Jpn. Pat. Appln. KOKAI Publication No. 10-138520 discloses a drum rotation ink-jet printer, which can make a large number of prints in a short period of time. The drum rotation ink-jet printer comprises a rotary drum which rotates in one direction and a print head for printing an image to a paper sheet wound around the rotary drum and rotating along with the drum. The print head has a plurality of ink-jet nozzles arranged in the axial direction of the rotary drum to extend across the paper sheet, and ejects ink from the ink-jet nozzles onto the paper sheet, which is moved relative to the print head by rotation of the rotary drum. Since this structure does not require considerable movement of the print head as in the conventional serial ink-jet printer, printing can be performed at high speed. Further, since ink is supplied to the print head from an ink tank of a large capacity located apart from the print head, the number of sheets printed for each supplementation of ink can be increased.

In the drum rotation ink-jet printer of the above-described type, the ink tank is located at a position remote from the printer head, and is used to supply ink to the print head. The ink tank has such a structure that an ink bottle filled up with reserve ink can be attached to and detached from the upper part of the tank. As the ink bottle is attached to the ink tank, ink is supplemented from the ink bottle to the ink tank until the surface of the ink liquid is leveled to a predetermined height.

The ink-jet nozzles described above are used to print extremely fine ink dots and therefore the print quality is deteriorated by dusts mixed in the ink and ink mist. In order to avoid such deterioration, a filter is interposed in an ink supply path provided between the ink tank and the print head in order to remove dusts mixed in the ink. Further, the ink supply path is designed in such a layout that the stagnation of ink, which cause ink mist, does not occur.

In the meantime, ink is manufactured by mixing a coloring additive to a main solvent, and therefore in some cases, the coloring additive remains in the ink as a fine particle after the ink is manufactured, or particle dusts are mixed into the ink while it is being manufactured. However, in the conventional ink-jet printer, a filter and an ink supply path do not have a structure of removing foreign matters such as fine particles of coloring additives and particle dusts. If such foreign matters are actually supplemented from the ink bottle to the ink tank, it is possible that the flow of ink is disturbed in the ink supply path and clogging of ink-jet nozzles occurs. Such drawbacks make it difficult to achieve printing of high-quality images at high speed.

Apart from the above, the conventional ink bottle easily falls out of the ink tank due to an external shock, which causes leaking of ink from the ink bottle. Such leaking of ink occurs also when the ink bottle is detached from the ink tank for replacement.

BRIEF SUMMARY OF THE INVENTION

The present invention has been proposed as a solution to the above-described problems of the conventional technique, and the object thereof is to provide an ink supplement system capable of surely preventing ink containing foreign matters from being supplemented into the ink tank.

According to the present invention, there is provided an ink supplement system which comprises a bottle holder unit for holding an ink bottle storing ink and detachably attached thereto; and an ink tank for receiving ink from the ink bottle held by the bottle holder unit, wherein the ink bottle includes an ink supply port having a filter affixed to the back thereof and the bottle holder unit includes an ink supplement pump which suctions ink through the ink supply port of the ink bottle attached to the bottle holder unit so as to supplement the ink into the ink tank.

In the ink supplement system, the filter is affixed to the back of the ink supply port, and the ink supplement pump suctions ink through the ink supply port of the ink bottle attached to the bottle holder unit so as to supplement ink into the ink tank. Since the ink is forced to penetrate the filter by suction force of the ink supplement pump, the mesh of the filter can be made at a sufficiently fine pitch. Therefore, even if foreign matters such as fine particles of coloring additives and particle dusts are contained in the ink, the filter can reliably remove them from the ink to supplement it into the ink tank.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An ink-jet printer according to an embodiment of the present invention will now be described with reference to accompanying drawings.

Figure 1:
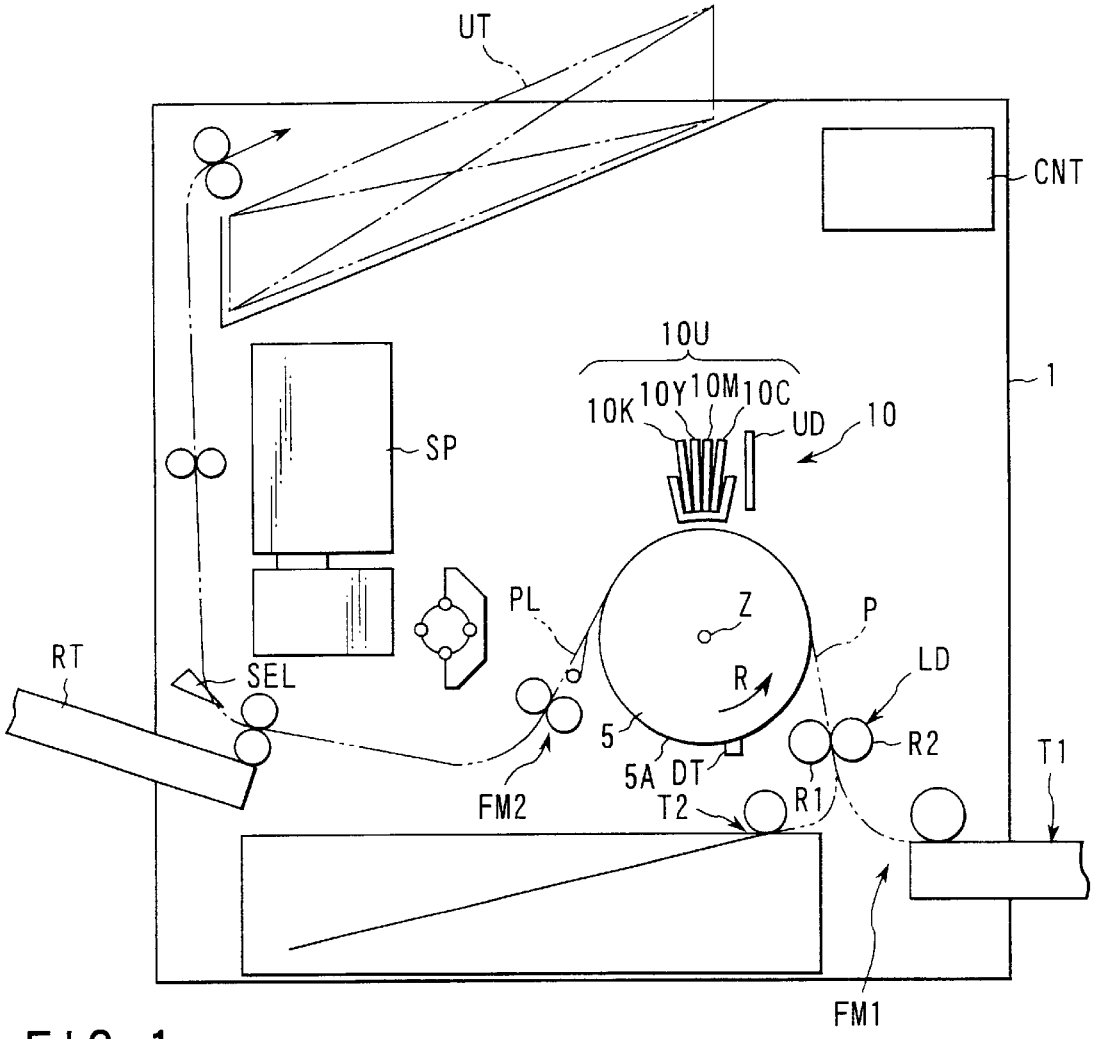
FIG. 1 is a view schematically showing an internal structure of an ink-jet printer according to an embodiment of the present invention.

FIG. 1 schematically shows an internal structure of the ink-jet printer. The ink-jet printer is used to print a multicolor image on a paper sheet P cut as a print medium. The paper sheet P may be a plain paper sheet, an OHP sheet or the like.

The ink-jet printer comprises a rotary drum 5 rotating at a predetermined circumferential speed, with a paper sheet P held thereon, a print head 10 for printing a multicolor image on the paper sheet P rotating along with the rotary drum 5, a manual-feed tray T1 on which each of paper sheets to be fed one by one is placed, a sheet cassette T2 for storing a stack of paper sheets P to be fed one on another, a sheet feed-in mechanism FM1 for feeding each paper sheet P from the sheet cassette T2 and manual-feed tray T1 into the rotary drum 5, a sheet feed-out mechanism FM2 for feeding out the paper sheet P printed on the rotary drum 5, and a control unit CNT for controlling the overall operation made by the components of the ink-jet printer. As shown in FIG. 1, the rotary drum 5 is located near the central position within a housing 1. The manual-feed tray T1 is located below the rotary drum 5 and extends externally from a front surface of the housing 1, and the sheet cassette T2 is located under the rotary drum 5. The sheet feed-in mechanism FM1 is placed between the manual-feed tray T1 and the sheet cassette T2. The print head 10 is located above the rotary drum 5. The sheet feed-out mechanism FM2 is located on a rear side of the rotary drum 5.

The rotary drum 5 is supported to be rotatable about the axis Z, and causes the paper sheet P to be wound around and held on a peripheral surface 5A thereof in accordance with its rotation indicated by an arrow R. The rotational position of the rotary drum 5 is detected by a rotational position detector DT, which is disposed near the peripheral surface 5A of the rotary drum 5. The print head 10 includes four nozzle units 10U (10C, 10M, 10Y and 10K) which are arranged in order along the peripheral surface 5A of the rotary drum 5 from the upstream side to the downstream side so as to perform a printing on the paper sheet P with inks of cyan (C), magenta (M), yellow (Y), and black (K). The nozzle units 10U receive inks of corresponding colors from an ink supply system SP. Each of the nozzle units 10U (10C, 10M, 10Y and 10K) has a plurality of ink-jet nozzles NL which are arranged in the axial direction of the rotary drum 5 to have a span corresponding to the width of the paper sheet P of A4 size and eject the corresponding color ink to the paper sheet P, and an ink pressure chamber 12 for supplying ink directly to these ink jet nozzles NL. The pitch PT of the ink-jet nozzles 23 is set to 1/150 inch, for example, in the case where the printing resolution is 300 dpi in the main scanning direction X.

The sheet feed-in mechanism FM1 has a sheet loader LD for loading the paper sheet P to the rotary drum 5 such that the width direction of the paper sheet P coincides with the axial direction of the rotary drum 5. The paper sheet P is taken out of either the manual-feed tray T1 or the sheet cassette T2, to be sent to the sheet loader LD. The sheet loader LD is controlled to load the paper sheet P toward the rotary drum 5 when the position detector DT detects that the rotary drum 5 has been rotated to a predetermined position. The print head 10 prints a multicolor image on the paper sheet P as the rotary drum 5 rotates.

The paper sheet P is unloaded from the peripheral surface 5A of the rotary drum 5 by a sheet unloader PL and fed in a predetermined direction by the sheet feed-out mechanism FM2. The sheet unloader PL is a separation pawl which is brought into contact with the rotary drum 5 at the time of sheet unloading. A discharge switch SEL guides the paper sheet P to a selected one of a rear discharge tray RT which stores a paper sheet with the print surface thereof facing upward on the rear discharge tray RT, and an upper discharge tray UT which stores a paper sheet with the print surface thereof facing downward on the upper discharge tray UT.

The print head 10 is capable of being reciprocally shifted by 1/75 inch in the main scanning direction X parallel to the axial direction of the rotary drum 5. The rotary drum 5 holds the paper sheet P wound around the peripheral surface 5A, and rotates to move the paper sheet P in a sub-scanning direction Y perpendicular to the main scanning direction X, with the paper sheet P opposing to the nozzle units 10U (10C, 10M, 10Y and 10K). The rotary drum 5 is maintained at a constant rotation rate of 120 rpm and makes one rotation every 0.5 second, for example. In the printing operation, the print head 10 is shifted in the main scanning direction X at a constant rate of ½ nozzle pitch PT each time the rotary drum 5 makes one rotation, so that it moves for a distance equal to the nozzle pitch PT while the rotary drum 5 makes two rotations.

The sheet loader LD) includes at least a pair of loading rollers R1 and R2 extending in the axial direction of the drum 5 to load the paper sheet P fed from the manual-feed tray T1 or sheet cassette T2 to the rotary drum 5 at a predetermined timing. The feed speed of the paper sheet P is set to a value corresponding to the circumferential speed of the rotary drum 5. Since the diameter of the rotary drum 5 is set to 130 mm, a circumferential speed of 816 mm/sec can be obtained. The peripheral surface 5A of the rotary drum 5 is about 220 mm wide in the axial direction and 408 mm long in the rotational direction. Therefore, the rotary drum 5 can fully hold an A4 size paper sheet P having a length of 297 mm and a width of 210 mm.

Figure 3:
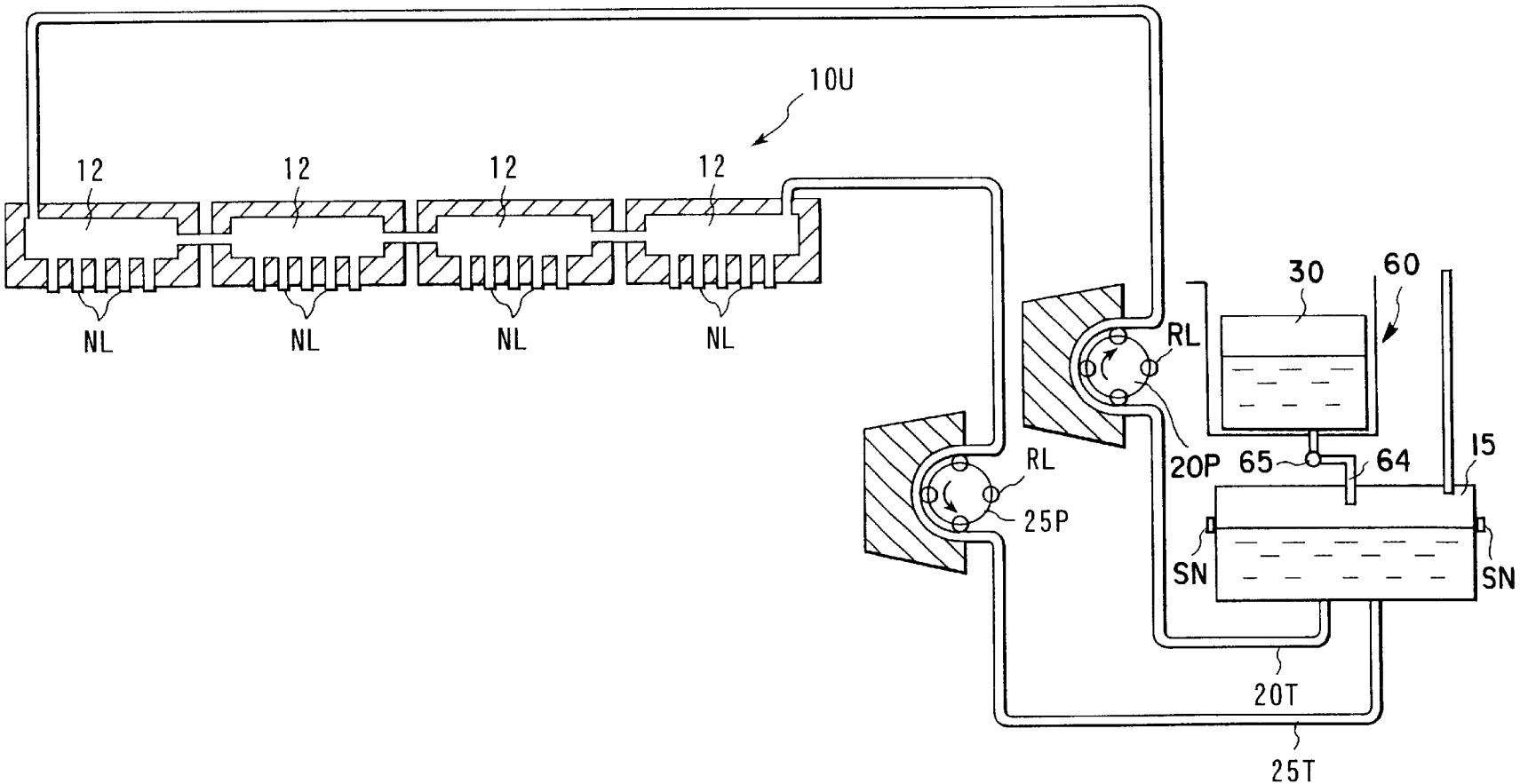
FIG. 3 is a view showing an ink supply section of the ink-jet printer shown in FIG. 1.

The ink supply system SP includes four ink supply sections for nozzle units 10U. As shown in FIG. 3, each ink supply section includes an ink tank 15 which is disposed apart from the print head 10 and stores ink, an ink bottle 30 for storing ink reserved for the ink tank 15, an ink supply tube 41 for guiding ink from the ink tank 15 to the nozzle unit 10U, and an ink return tube 25T for guiding ink from the nozzle unit 10U to the ink tank 15. The ink supply section further includes a supply pump 20P interposed in the ink supply tube 20T, and a return pump 25P interposed in the ink return tube 25T. The supply pump 20P performs an ink supply operation of flowing ink from the ink tank 15 to the nozzle unit 10U through the ink supply tube 20T. The return pump 25P performs an ink suction operation of flowing excessive ink from the nozzle unit 10U to the ink tank 15 through the ink return tube 25P.

Each of the ink supply tube 20T and ink return tube 25T is constituted by an elastic tube of soft synthetic resin. Each of the supply pump 20P and return pump 25P is of a rotary type in which four press rollers RL are provided at a predetermined interval on a circular locus. Each pump has a valve function in which the press rollers RL are stopped to set the elastic tube to a selected one of open and closed states, and are rotated to forcibly flow ink with pressure. Ink is circulated between the ink tank 15 and the nozzle unit 10U of the print head 10 by simultaneously driving the supply pump 20T and the return pump 25P.

Figure 2:
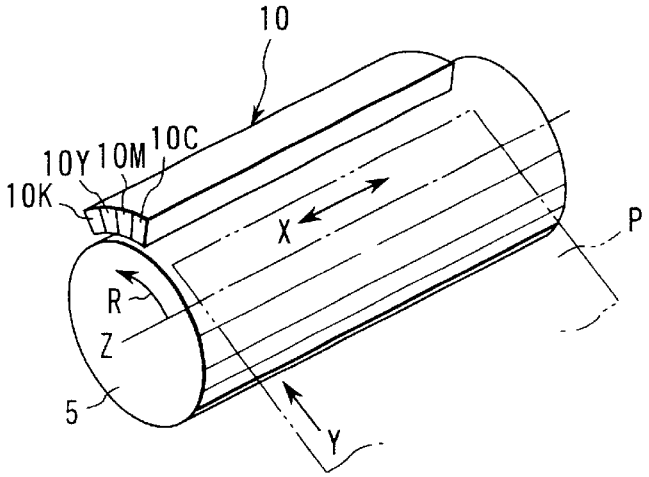
FIG. 2 is a perspective view showing a positional relationship between the rotary drum and the print head shown in FIG. 1.
Figure 4:
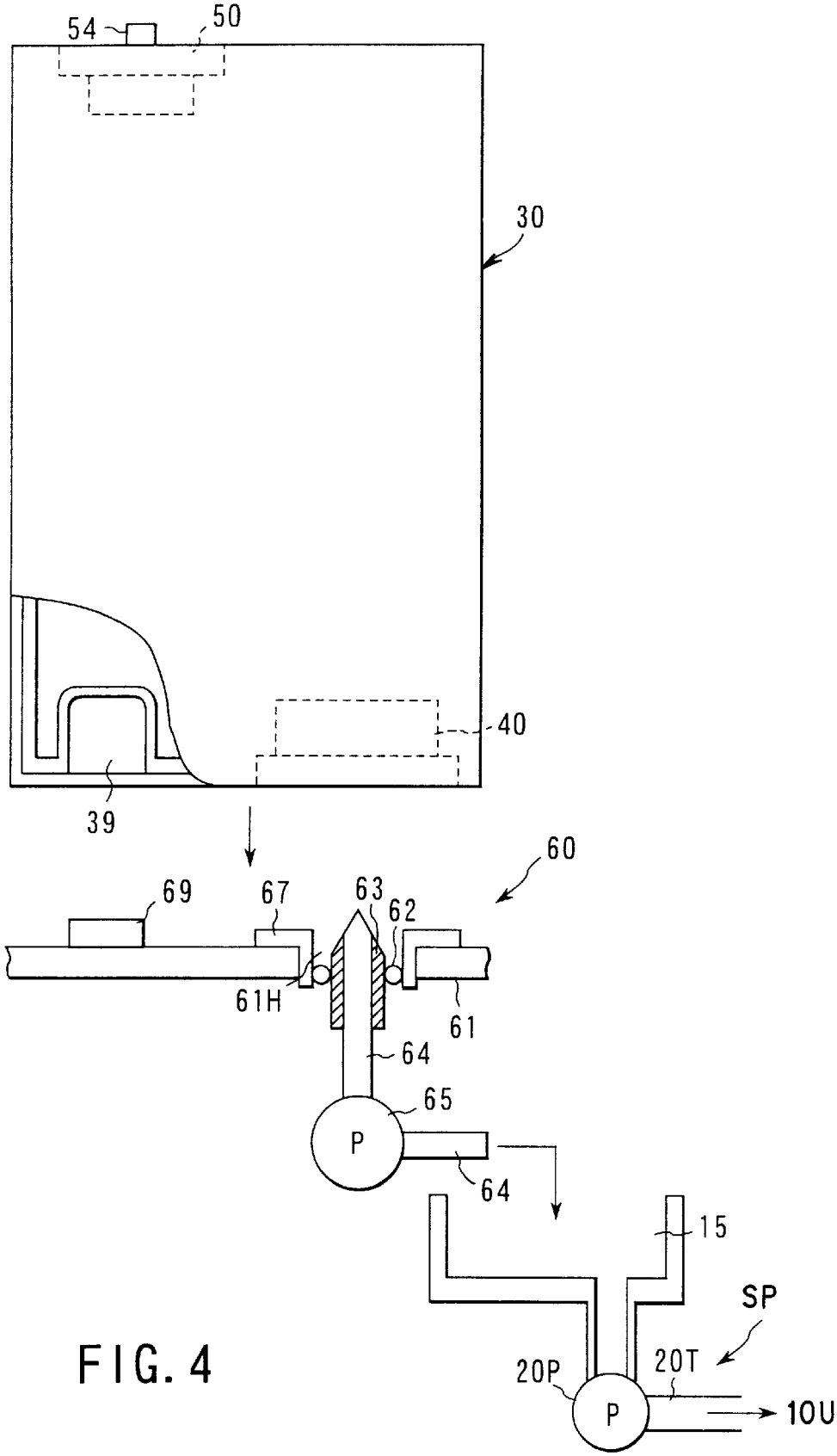
FIG. 4 is a view showing an ink supplement system for supplementing ink from the ink bottle to the ink tank shown in FIG. 3.

As shown in FIG. 4, the ink supply section comprises an ink supplement system which includes an ink bottle holder unit 60 for holding an ink bottle storing ink and detachably attached thereto, an ink supplement tube 64 connected between the ink bottle holder unit 60 and the ink tank, and an ink supplement pump 65 interposed in the ink supplement tube 64. The ink supplement pump 65 is controlled by the control unit CNT shown in FIG. 1 to suction ink from the ink bottle 30 attached to the ink bottle holder unit 60 and supply the ink to the ink tank 15. The control unit CNT drives the ink supplement pump 65 in response to an ink supplement request signal produced when it is detected by the liquid level sensor SN shown in FIG. 2 that the liquid level of ink is decreased below a predetermined height in the ink tank 15.

The ink bottle holder unit 60 includes a base member 61 formed integral with the housing 1 to receive the ink bottle 30, an engagement projection 69 to be engaged with the ink bottle 30 received in the base member 61, a suction nozzle 63 to be communicate with the ink bottle 30 in a state where the engagement projection is engaged with the ink bottle 30, and a sealing pedestal 67 mounted on the base member 61 to surround the suction nozzle 63. The base member 61 includes a hole 61H formed at the bottom thereof to receive the suction nozzle 63. The suction nozzle 63 is connected to an end of the ink supplement tube 64, and fixed to the base member 61 such that it is received in the hole 61H along with a sealing member 62 such as an O-ring placed to eliminate a gap between the sealing pedestal 67 and the suction nozzle 63 and projects upward from the hole 61H by a predetermined length. The engagement projection 69 is formed on the bottom surface of the base member 61 and has an individual shape determined for each color (i.e., cyan, magenta, yellow or black) of ink stored in the ink bottle 30, so that attachment of only the ink bottle 30 storing ink of a corresponding color can be accepted. For example, a column having a square, circular or triangle cross section, or a cone, or pyramid, or the like is used as the engagement projection 69. The engagement projection 69 may be the column, cone, or pyramid of a similar shape which has a different size for each ink color.

Figure 5:
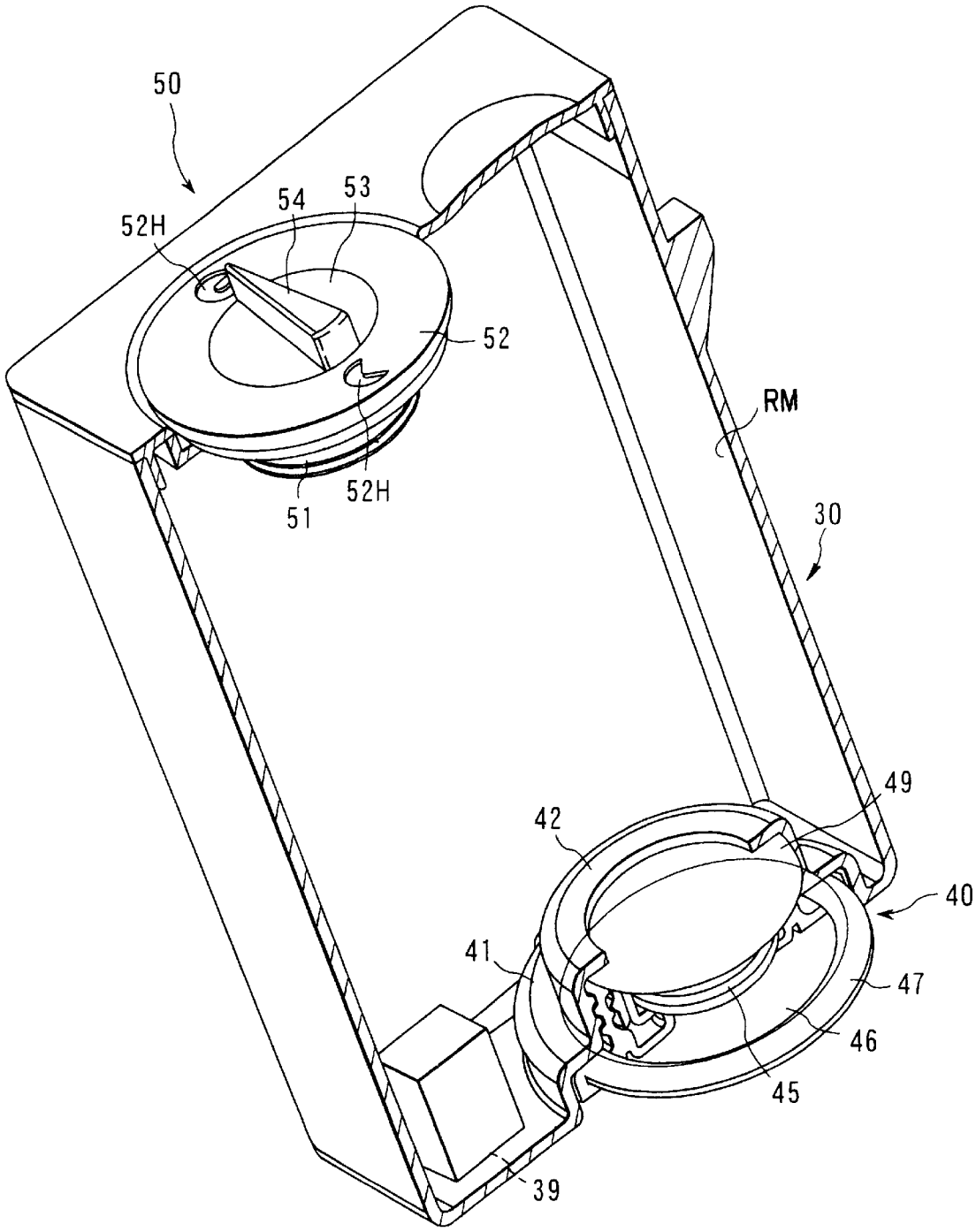
FIG. 5 is a broken perspective view showing the ink bottle shown in FIG. 3 as viewed from the upper side.

As shown in FIG. 5, the ink bottle 30 has an ink chamber RM for storing ink, an ink supplement valve structure 40 formed at the bottom of the ink chamber RM to face the suction nozzle 63 at the time of attachment, a ventilation valve structure 50 formed at the top of the ink chamber RM, and a remaining ink amount reducing recess 39 formed at the bottom of the ink chamber RM to face the engagement projection 69 at the time of attachment. The remaining ink amount reducing recess 39 has a shape defined by the bottom of the ink bottle 30 which is dented inwards to fit the shape of the engagement projection 69. This prevents erroneous attachment of a wrong ink bottle 30 which does not contain ink of the color specified by the shape of the engagement projection 69, while reducing the volume of the ink chamber RM near the bottom thereof. If the shape of the engagement projection 69 is not fit for the shape of the remaining ink amount reducing recess 39, it will be difficult to attach the ink bottle 30 to the ink bottle holder unit 60.

Figure 6:
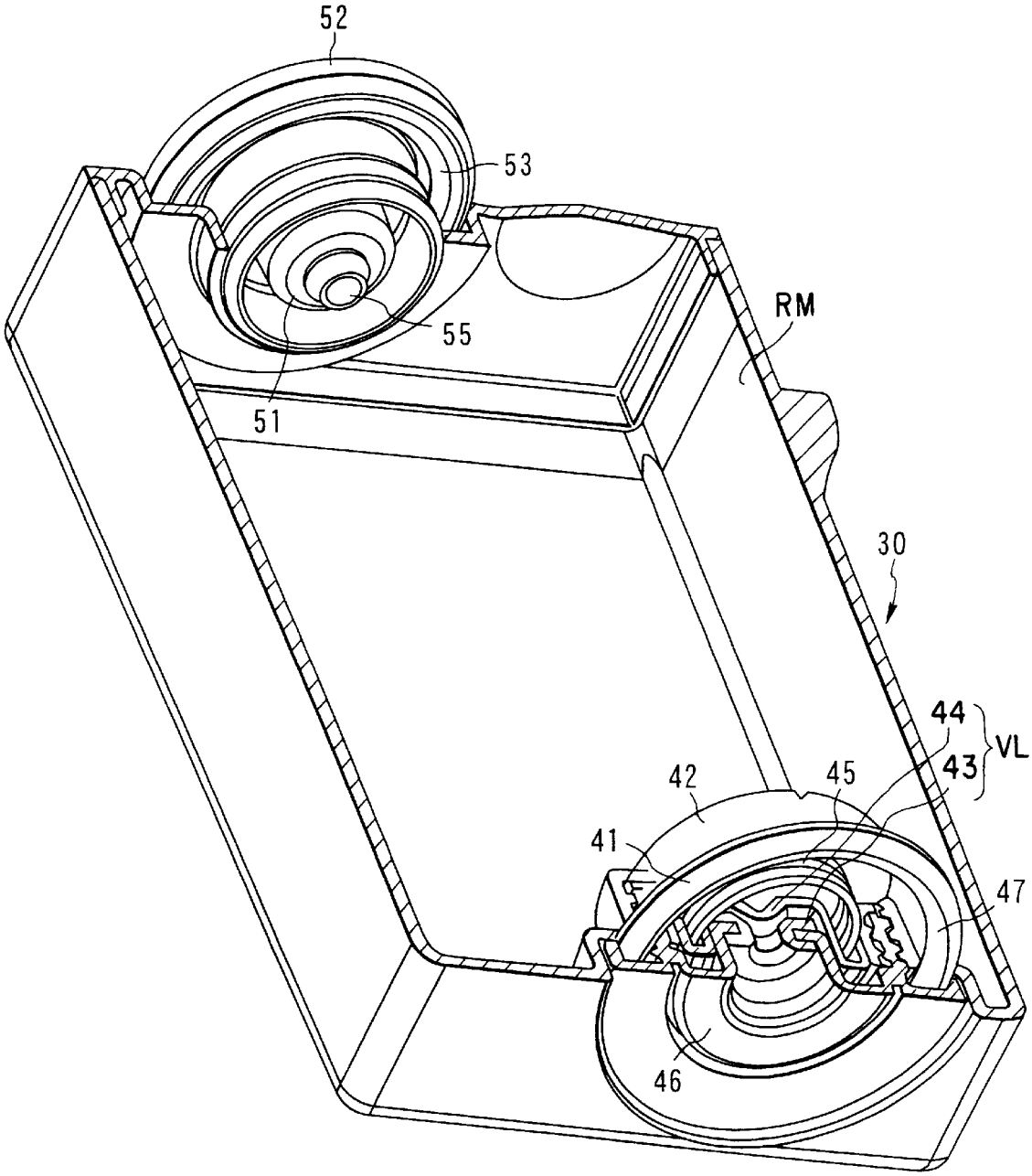
FIG. 6 is a broken perspective view showing the ink bottle shown in FIG. 3 as viewed from the lower side.

As shown in FIGS. 5 and 6, the ink supplement valve structure 40 includes an ink supplement valve VL for opening and closing an ink supply port 46, a valve enclosure 41 for enclosing the ink supplement valve VL, a filter enclosure 42 for enclosing a disk-shaped filter 49 affixed to the top of the valve enclosure 41, and a spring 45 for urging the ink supply valve VL. The filter enclosure 42 has a structure requiring that ink stored in the ink chamber RM penetrates the filter 49 to reach the ink supply port 46. If ink contains foreign matters such as fine particles of coloring additives and particle dusts, the foreign matters are removed from the ink by the filter 49. The ink supplement valve VL is made of a valve seat 43 having an opening located at the center thereof and fixed to the ink supply port 46, and a valve body 44 put on the valve seat 43. The spring 45 urges the valve body 44 toward the valve seat 43 by applying an urging force downward. Unless an external force applied against the urging force of the spring 45 pushes the valve body 44 back, the ink supplement valve VL maintains the ink supply port 46 to be closed. The valve body 44 is brought into contact with the suction nozzle 65 upon attachment of the ink bottle 30, and is pushed upward and separated from the valve seat 43 by the external force applied from the suction nozzle 65 serving as an actuator. Thus, the ink supplement valve VL maintains the ink supply port 46 to be opened after the attachment of the ink bottle 30.

The ventilation valve structure 50 includes a removable disk-shaped guide plate 52 having two air intakes 52H and fixed to the top of the ink bottle 30, an open/close plate 53 coupled to the guide plate 52 and rotatable to open and close the air intakes 52H, and a knob 54 which is manually operated to rotate the open/close plate 53 about an axis 55, for example. The ventilation valve structure 50 is sealed such that ink does not leak even if the ink bottle 30 is inclined in a state where the air intakes 52H are closed by the open/close plate 53. The air intakes 52 are opened to ventilate the ink bottle 30, thereby preventing negative pressure from being created in the ink chamber RM while the ink supplement pump 65 suctions ink through the suction nozzle 63. In this way, the ink chamber RM is maintained to be in the atmospheric pressure, the load on the ink supply pump 20P is reduced. Thus, the mesh of the filter 49 can be made finer. It should be noted that the ventilation valve structure 50 is not limited to the above-described configuration.

Figure 7:
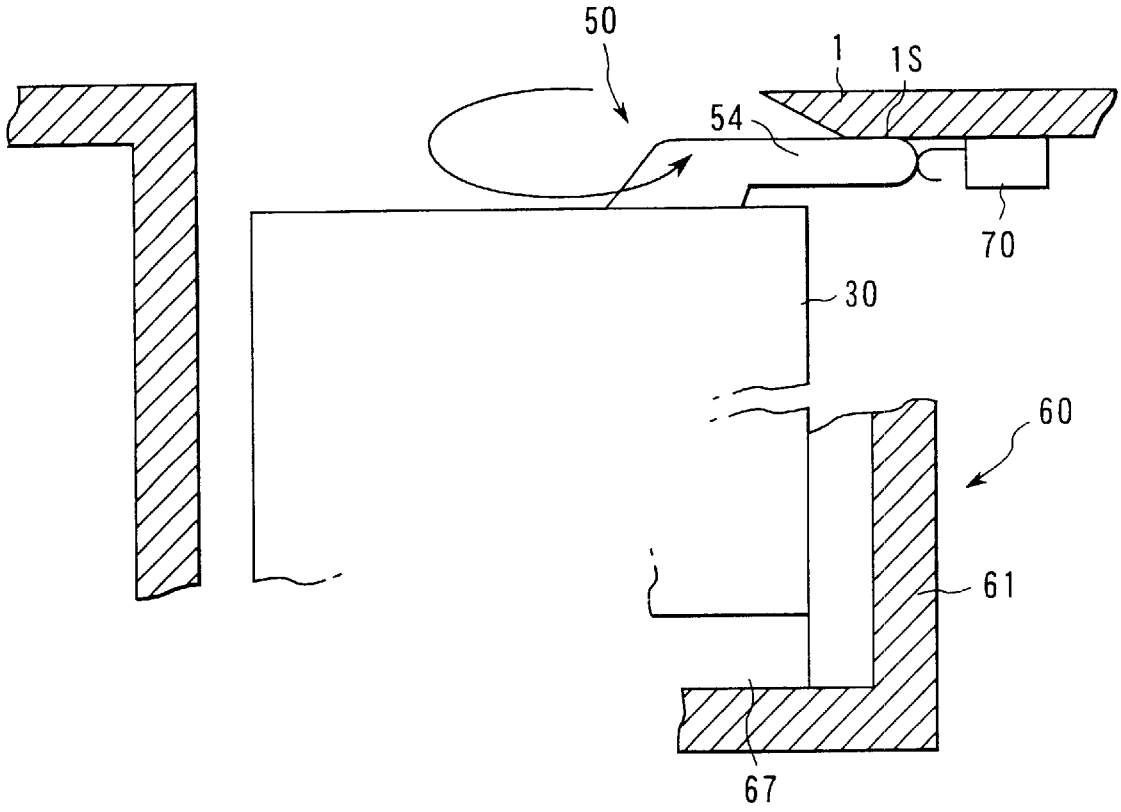
FIG. 7 is a view for explaining a structure of preventing a rise of the ink bottle shown in FIG. 3.

FIG. 7 shows a rise preventing structure of the ink bottle 30. If the ink bottle 30 is raised from the ink bottle holder unit 60, leaking of ink may occur. To prevent this, the knob 54 is formed in a shape shown in FIG. 7, and the ink bottle holder unit 60 includes an arm 1S extending from the housing 1 to engage with the knob 54 set to a position for opening the air intakes 52H. Thus, the vertical movement of the ink bottle 30 is disabled. When the knob 54 is returned to a position for opening the air intakes 52, the ink bottle 30 can be detached from the ink bottle holder unit 60. Further, the ink bottle holder unit 60 may include an attachment sensor 70 for sensing that attachment of the ink bottle 30 has been completed and the air intakes 52H have been opened. The attachment sensor 70 is formed, for example, of a switch which is operated to generate a supplement ready signal by a mechanical force applied when the knob 54 is engaged with the arm 1S as shown in FIG. 7. In a case where no supplement ready signal is generated from the attachment sensor 70, the control unit CNT does not drive the ink supplement pump 65 even if the ink supplement request signal is generated from the liquid level sensor SN. That is, the ink supplement pump 65 is driven after generation of the supplement ready signal.

With the ink-jet printer described above, the ventilation valve structure 50 is detached and ink of each color is poured into the ink bottle 30 specified for the color. At this time, the ink is not leaked from the ink bottle 30 since the ink supply port 46 is normally in a state closed by the ink supplement valve VL. After pouring of the ink, the ventilation valve structure 50 is attached to the ink bottle 30, and the knob 54 is set to a position for closing the air intakes 52H.

When attachment of the ink bottle 30 to the ink bottle holder unit 60 of the ink-jet printer is carried out, an operator confirms that the shape of the remaining ink reducing recess 39 of the ink bottle 30 is fit for the shape of the engagement projection 69 of the ink bottle holder unit 60, places the ink bottle 30 on the bottom surface of the base member 61 in such a manner that the bottle 30 is not inclined and the recess 39 and the ink supply port 46 are respectively opposed to the engagement projection 69 and the suction nozzle 63, and then turns the knob 54 to the position for opening the air intakes 52H. In a case where the recess 39 is not engaged with the engagement projection 69, this inclines the ink bottle 30 placed on the bottom surface of the base member 61 and disables that the knob 54 is turned to the position for opening the air intakes 52H. Therefore, the operator will find that the ink bottle 30 of a wrong ink color was used for attachment to the ink bottle holder unit 60. When the ink bottle 30 placed on the bottom surface of the base member 61 is not inclined, the air intakes 52H can be opened by turning the knob 54, and also the knob 54 can be engaged with the arm 1S. Rise of the ink bottle 30 is disturbed in this state. On the other hand, when the ink bottle 30 is placed on the bottom surface of the base member 61 without inclination, the suction nozzle 63 is inserted through the opening of the valve seat 43 and pushes the valve body 44 against the urging force of the spring 45, so that the valve body 44 can be separated from the valve seat 43. Thus, the ink supplement valve VL opens the ink supply port 46.

The internal space of the ink bottle 30 is set to be in the atmospheric pressure by opening the air intakes 52H, and the supplement ready signal is generated from the attachment sensor 70 when the knob 54 is engaged with the arm 1S. Thus, the ink supplement pump 65 becomes ready to suction ink from the ink bottle 30 upon generation of the ink supplement request signal from the liquid level sensor SN. When ink is actually suctioned, the ink is forced to penetrate the filter 49 in the ink bottle 30, so that foreign matters such as fine particles of coloring additives and particle dusts contained in the ink can be removed by the filter 49. Accordingly, the ink tank 15 receives the ink of good quality supplemented without the foreign matters that may cause clogging of the ink-jet nozzles NL.

When detachment of the ink bottle 30 from the ink bottle holder unit 60 of the ink-jet printer is carried out, the operator turns the knob 54 back to the position for closing the air intakes 52H to release the engagement between the knob 54 and the arm 1S. Thus, the ink bottle 30 can be lifted up by hand. When the ink supply port 46 of the ink bottle 30 is detached from the suction nozzle 63, the valve body 44 is brought into contact with the valve seat 43 again due to the urging force of the spring 45. That is, the ink supplement valve VL closes the ink supply port 46. Accordingly, no ink leaks from the ink bottle 30, regardless of the posture of the ink bottle 30.

In the embodiment described above, the filter 49 is affixed to the ink supply port 46 of the ink bottle on the internal side, and ink supplement pump 65 suctions ink through the ink supply port 46 to supplement the ink to the ink tank 15 upon attachment of the ink bottle 30. Since the ink is forced to penetrate the filter 49 by the suction force of the ink supplement pump 65, the mesh of the filter can be made at a sufficiently fine pitch. Therefore, even if the ink contains foreign matters such as fine particles of coloring additives and particle dusts mixed therein, it can be supplemented to the ink tank 15 after the foreign matters are fully removed therefrom. Accordingly, the stagnation of ink and the clogging of the ink-jet nozzles NL are reliably prevented, so that high-quality images can be printed at high speed. In addition, since the ink supplying structure for supplying ink between the ink tank 15 and the print head 10 can be simplified, the manufacturing cost of the ink-jet printer can be reduced, and the printer can be downsized.

The ink supplement valve VL closes the ink supply port 46 by using the urging force of the spring 45 which is applied to the valve body 44 so as to bring it into contact with the valve seat 43, and opens the ink supply port 46 by using the external force which is applied from the suction nozzle 63 to the valve body 44 against the urging force of the spring 45 upon attachment of the ink bottle 30 so as to separate the valve body 44 from the valve seat 43. Thus, leaking of ink can be prevented at the time of attaching or detaching the ink bottle 30.

The air intakes 52H are disposed at the top of the ink bottle 30, and opened to maintain the ink chamber RM to be in the atmospheric pressure by the knob 54 of the ventilation valve structure 50 which is turned after attachment of the ink bottle 30. This reduces the load on the ink supplement pump 65, so that the mesh of the filter 49 can be made at a finer pitch. On the other hand, the ink can be stably and accurately suctioned even if the ink supplement pump 65 is of a small capacity type.

Further, since the knob 54 is engaged with the arm 1S at the above-described position for opening the air intakes 52H, rising up of the ink bottle 30 from the base member 61 can be prevented.

Moreover, the engagement projection 69 is formed on the bottom surface of the base member 61 and have an individual shape determined for each color (i.e., cyan, magenta, yellow or black) of ink, and the remaining ink amount reducing recess 39 is formed at the bottom of the ink chamber RM to face the engagement projection 69 at the time of attachment and has a shape defined by the bottom of the ink bottle 30 which is dented inwards to fit the shape of the engagement projection 69. Since the volume of the ink chamber RM is reduced near the bottom thereof, the amount of ink left without being suctioned by the suction nozzle 63 can be decreased. Further, it is possible to prevent erroneous attachment of a wrong ink bottle 30 which does not contain ink of the color specified by the shape of the engagement projection 69. As a result, the ink-jet printer can be manufactured in more compact by installing ink bottles 30 containing inks of different colors into spaces close to each other.

The ink supply port 46 is disposed at the bottom of the ink bottle 30, and the ink supplement valve structure 40 is accommodated in the internal space of the ink bottle 30 such that ink penetrates the filter 49 at a position higher than the bottom of the ink bottle 30 and is guided directly to the ink supply port 46. Therefore, the ink can be prevented from being suctioned together with foreign matters such as fine particles of coloring additives and particle dusts stacked on the bottom of the ink bottle 30.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink supplement system comprising:

a bottle holder unit for holding an ink bottle storing ink and detachably attached thereto; and an ink tank for receiving ink from said ink bottle held by said bottle holder unit;

wherein said ink bottle includes an ink supply port having a filter affixed to a back thereof, and said bottle holder unit includes an ink supplement pump which is coupled to the ink supply port of said ink bottle upon attachment of said ink bottle and which suctions ink through said ink supply port so as to supplement the ink into said ink tank.

2. The ink supplement system according to claim 1, wherein said ink bottle further includes an ink supplement valve structure, and said bottle holder unit includes an actuator for actuating said ink supplement valve structure to open said ink supply port upon attachment of said ink bottle.

3. The ink supplement system according to claim 2, wherein said ink supplement valve structure includes:

an ink supplement valve composed of a valve seat having an opening located at a center thereof and fixed to said ink supply port, and a valve body placed on said valve seat, and an urging member for applying an urging force to said valve body such that said valve body is brought into contact with said valve seat; and said bottle holder unit further includes:

a supporting member for supporting said ink bottle, and a suction nozzle connected to said ink supplement pump and projected from said supporting member as said actuator to separate said valve body from said valve seat against the urging force of said urging member upon attachment of said ink bottle.

4. The ink supplement system according to claim 3, wherein said ink supply port is disposed at the bottom of said ink bottle, and said ink supplement valve structure is accommodated in an internal space of said ink bottle such that ink penetrates said filter at a position higher than the bottom of said ink bottle and is guided directly to said ink supply port.

5. The ink supplement system according to claim 1, wherein said ink supply port is disposed at the bottom of said ink bottle, and said ink bottle includes an air intake disposed at the top of said ink bottle, and a ventilation valve structure for opening and closing said air intake.

6. The ink supplement system according to claim 5, wherein said ventilation valve structure includes a knob set at an opening position for opening said air intake when said ink bottle is attached to said bottle holder unit, and said bottle holder unit includes an engagement member which is engaged with said knob set at the opening position to prevent rising up of said ink bottle.

7. The ink supplement system according to claim 6, wherein said bottle holder unit includes an attachment sensor for sensing that said knob and said engagement member have engaged with each other in a state that said ink bottle is completely attached.

8. The ink supplement system according to claim 1, wherein said ink bottle includes a recess formed to reduce the volume near the bottom thereof.

9. The ink supplement system according to claim 8, wherein said bottle holder unit includes a projection of an individual shape assigned to a color of the ink stored in said ink bottle, and said recess is formed to have a position and the shape which fit said projection when said ink bottle is attached.

10. An ink jet printer comprising:

a print head which prints an image on a paper sheet with ink;

a bottle holder which holds an ink bottle storing ink and detachably attached thereto, said ink bottle having an ink supply port and a filter affixed over said bottle holder;

an ink tank which receives the ink from said ink bottle held by said bottle holder;

an ink supplement pump which is coupled to the ink supply port of said ink bottle upon attachment of said ink bottle and suctions the ink through said ink supply port so as to supplement the ink into said ink tank; and an ink supply mechanism to supply the ink from said ink tank to said print head.

11. The ink jet printer according to claim 10, wherein said ink bottle further includes:

an ink supplement valve composed of a valve seat having an opening located at a center thereof and fixed to said ink supply port and a valve body placed on said valve seat; and a spring which applies an urging force to said valve body such that said valve body is brought into contact with said valve seat; and wherein said bottle holder unit further includes:

a supporting member which supports said ink bottle; and a suction nozzle connected to said ink supplement pump and projected from said supporting member to separate said valve body from said valve seat against the urging force of said spring upon attachment of said ink bottle.

12. The ink jet printer according to claim 10, wherein said ink bottle includes an air intake disposed at the top of said ink bottle, and a knob configured to open and close said air intake.

13. The ink jet printer according to claim 10, wherein said ink bottle includes a recess formed to reduce the volume near the bottom thereof.

14. An ink supplement system comprising:

a bottle holder which holds an ink bottle storing ink and detachably attached thereto, said ink bottle having an ink supply port and a filter affixed over said bottle holder;

an ink tank which receives the ink from said ink bottle held by said bottle holder; and an ink supplement pump which is coupled to the ink supply port of said ink bottle upon attachment of said ink bottle and suctions the ink through said ink supply port so as to supplement the ink into said ink tank.

15. The ink supplement system according to claim 14, wherein said ink bottle further includes:

an ink supplement valve composed of a valve seat having an opening located at a center thereof and fixed to the ink supply port and a valve body placed on said valve seat; and a spring which applies an urging force to said valve body such that said valve body is brought into contact with said valve seat; and wherein said bottle holder includes:

a supporting member which supports the ink bottle; and a suction nozzle connected to said ink supplement pump and projected from said supporting member to separate said valve body from said valve seat against the urging force of said spring upon attachment of said ink bottle.

16. The ink supplement system according to claim 15, wherein said ink supply port is disposed at the bottom of said ink bottle which contacts said bottle holder.

17. The ink supplement system according to claim 15, wherein said ink supplement valve structure is accommodated in an internal space of the bottom of said ink bottle and the ink is guided directly to said ink supply port.

18. The ink supplement system according to claim 14, wherein said ink bottle includes an air intake disposed at the top of the ink bottle, and a knob configured to open and close said air intake.

19. The ink supplement system according to claim 18, wherein said knob is moved at an opening position to open said air intake when the ink bottle is attached to said bottle holder.

20. The ink supplement system according to claim 19, wherein said bottle holder includes an engagement member which is engaged with said knob moved at the opening position to prevent rising up of said ink bottle.

21. The ink supplement system according to claim 20, wherein said bottle holder includes an attachment sensor to sense that said knob and said engagement member have engaged with each other in a state that said ink bottle is completely attached.

22. The ink supplement system according to claim 20, wherein said ink supplement pump is driven when said attachment sensor senses that said knob and said engagement have engaged with each other.

23. The ink supplement system according to claim 14, wherein said ink bottle includes a recess which reduces the volume near the bottom thereof.

24. The ink supplement system according to claim 23, wherein said bottle holder includes a projection of an individual shape assigned to a color of the ink stored in said ink bottle, and said recess is formed to have a position and shape which fit said projection when the ink bottle is attached.

* * * * *